US006470509B1

(12) United States Patent
Ayeni

(10) Patent No.: US 6,470,509 B1
(45) Date of Patent: Oct. 29, 2002

(54) SPA JET INCORPORATING A ROTATING NOZZLE HAVING A WATER LUBRICATED BEARING

(75) Inventor: Tokunbo Ayeni, Thousand Oaks, CA (US)

(73) Assignee: Pentair Pool Products, Inc., Moorpark, CA (US)

( * ) Notice: Subject to any disclaimer, the term of this patent is extended or adjusted under 35 U.S.C. 154(b) by 0 days.

(21) Appl. No.: 09/992,716

(22) Filed: Nov. 14, 2001

(51) Int. Cl.[7] ..... A61H 33/00
(52) U.S. Cl. ..... 4/541.6
(58) Field of Search ..... 4/541.1–541.6, 4/492; 239/434, 428.5

(56) References Cited

U.S. PATENT DOCUMENTS 4,715,071 A * 12/1987 Henkin et al. ..... 4/541.6
4,763,367 A * 8/1988 Henkin et al.
5,014,372 A * 5/1991 Thrasher et al.
5,657,496 A * 8/1997 Corb et al. ..... 4/541.6
5,810,257 A * 9/1998 Ton ..... 4/541.6
5,920,925 A * 7/1999 Dongo ..... 4/541.6
5,956,784 A 9/1999 Perdreau et al. ..... 4/541.1
5,983,417 A 11/1999 Perdreau et al. ..... 4/541.6
6,123,274 A 9/2000 Perdreau et al. ..... 239/581.1
6,178,570 B1 1/2001 Denst et al. ..... 4/541.6
6,264,122 B1 7/2001 Perdreau et al. ..... 239/600
6,322,004 B1 11/2001 Perdreau et al. ..... 239/428.5
6,334,224 B1 * 1/2002 Chalberg et al. ..... 4/541.6

* cited by examiner

*Primary Examiner*—Charles R. Eloshway
(74) *Attorney, Agent, or Firm*—Christie, Parker & Hale, LLP

(57) ABSTRACT

A spa jet of the type which utilizes a nozzle rotor for delivering a rotating jet of water into a spa is provided with a water-lubricated bearing for reducing frictional resistance to rotation. The rotor is supported by an inner bearing which is mounted for concentric rotation within an outer bearing in the housing. The inner and outer bearing surfaces which face each other include cylindrical side surfaces and upstream and downstream end wall surfaces defining a passage. The flow of water to lubricate the bearing surfaces is arranged to exert a net axial force that spaces at least one of the sets of end surfaces out of contact with each other to reduce friction and also lubricates and separates the cylindrical side surfaces.

8 Claims, 3 Drawing Sheets

SPA JET INCORPORATING A ROTATING NOZZLE HAVING A WATER LUBRICATED BEARING

BACKGROUND OF THE INVENTION

This invention relates to spa jets for hydrotherapy. In particular, it relates to a spa jet having a nozzle supported for rotation by a bearing in which a portion of the water flow is used to lubricate the rotating parts of the bearing.

In the art of hydrotherapy, it is known to utilize spa jets which direct water into the spa through one or more nozzles which rotate to distribute the water in a swirling motion against the skin of a person in the spa. Such a spa jet typically includes a housing, which communicates with an inlet connected to a pressurized source of water, and a bearing, mounted within the open end of the housing, which supports the nozzle for rotation. One such spa jet is, for example, shown in U.S. Pat. No. 5,014,372 to Thrasher et al., owned by the assignee of the present invention.

In the Thrasher prior art spa jet, two nozzles extend through a rotor mounted for rotation in the downstream end of the housing. The rotor is positioned between spring biased ring, at its upstream end, and a cage, at its downstream end, which has a flat bearing surface on which a nose portion of the rotor can rotate. This prior patent shows a space between a cylindrical side surface of the rotor and the adjacent internal surfaces of the housing and explains that water in this space surrounding the rotor acts as a lubricant and helps minimize the frictional forces that would otherwise resist rotation.

While the prior art device described may have been generally satisfactory for its intended purpose, there are respects in which improvement can be sought. In particular, it would be desirable to avoid an arrangement in which the rotor is exposed to frictional resistance to rotation against both its end surfaces. Also, the cage and the inclusion of a spring during assembly add manufacturing expense to a product where low price to the retail consumer is very important.

Accordingly, it is an object of the present invention to provide a spa jet, of the rotating nozzle type in which direct surface-to-surface friction at the ends of the rotor is minimized by increasing the extent to which the water itself is used to lubricate and support the rotor for free rotation. In addition, it is another objective to simplify the shapes of the parts used for ease of manufacture and to reduce the expense involved in assembling the spa jet from its components.

SUMMARY OF THE INVENTION

The present invention provides an improvement to a spa jet of the type having a housing, supplied by an upstream source of water under pressure, and a rotor within the housing which has a nozzle. The nozzle emits a water jet which exerts a turning moment about the axis that rotates the rotor thereby producing a swirling effect on the skin of a person in the spa against whom the spa jet is directed. The improvement resides in structure which mounts the rotor for low friction rotation by using a bearing which provides a layer of water which lubricates and supports the rotating parts to an increased extent.

More specifically, the bearing is comprised of a stationary, outer bearing mounted to the housing and a rotating, inner bearing which supports the rotor. The facing working surfaces of the two bearings are separated by an enveloping water stream that lubricates and supports the inner bearing for rotation to an increased degree. An annular space between the facing bearing surfaces will be referred to as the "bearing flow passage". The bearing flow passage includes an axially extending cylindrical region and radially extending end regions, defined by facing parallel surfaces of the inner and outer bearings. The radial area of the upstream end surfaces defining the bearing passage exposed to water pressure is sufficiently greater than the radial area of the downstream surfaces so that water flowing through the bearing flow passage exerts a net downstream axial force urging the facing surfaces of the inner and outer bearings into at least partial contact at the downstream end. In contrast, however, the upstream facing end surfaces are moved out of surface-to-surface contact, thereby reducing the surface-to-surface mechanical friction compared to prior devices having continuous surface-to-surface mechanical contact at both axial ends.

The magnitude of the net axial force affects the magnitude of the rotational frictional force due to surface-to-surface contact at the downstream axial end of the inner bearing. The invention is designed to lower this friction in three complementary ways. First, the difference in areas of the radial surfaces of the inner bearing exposed to liquid pressure at its opposite axial ends is not large. Second, the pressure in the bearing flow passage is lowered relative to the pressure of the jet stream, to diminish the net axial force. Third, the downstream radial end surface or its inner bearing is relieved to reduce the extent of surface-to-surface contact.

As another feature of the invention, most of the parts comprise volumes of rotation which can be molded with relatively low degree of complication. This avoids the relatively higher expense of machined or cast parts that are more difficult and expensive to make than volumes of rotation. In addition, the parts are relatively easily assembled together by tabs which snap into grooves, allowing the parts to be installed by a sequence of pushing actions, thereby reducing the cost of assembly.

DETAILED DESCRIPTION OF THE DRAWINGS

DETAILED DESCRIPTION

Figure 1:
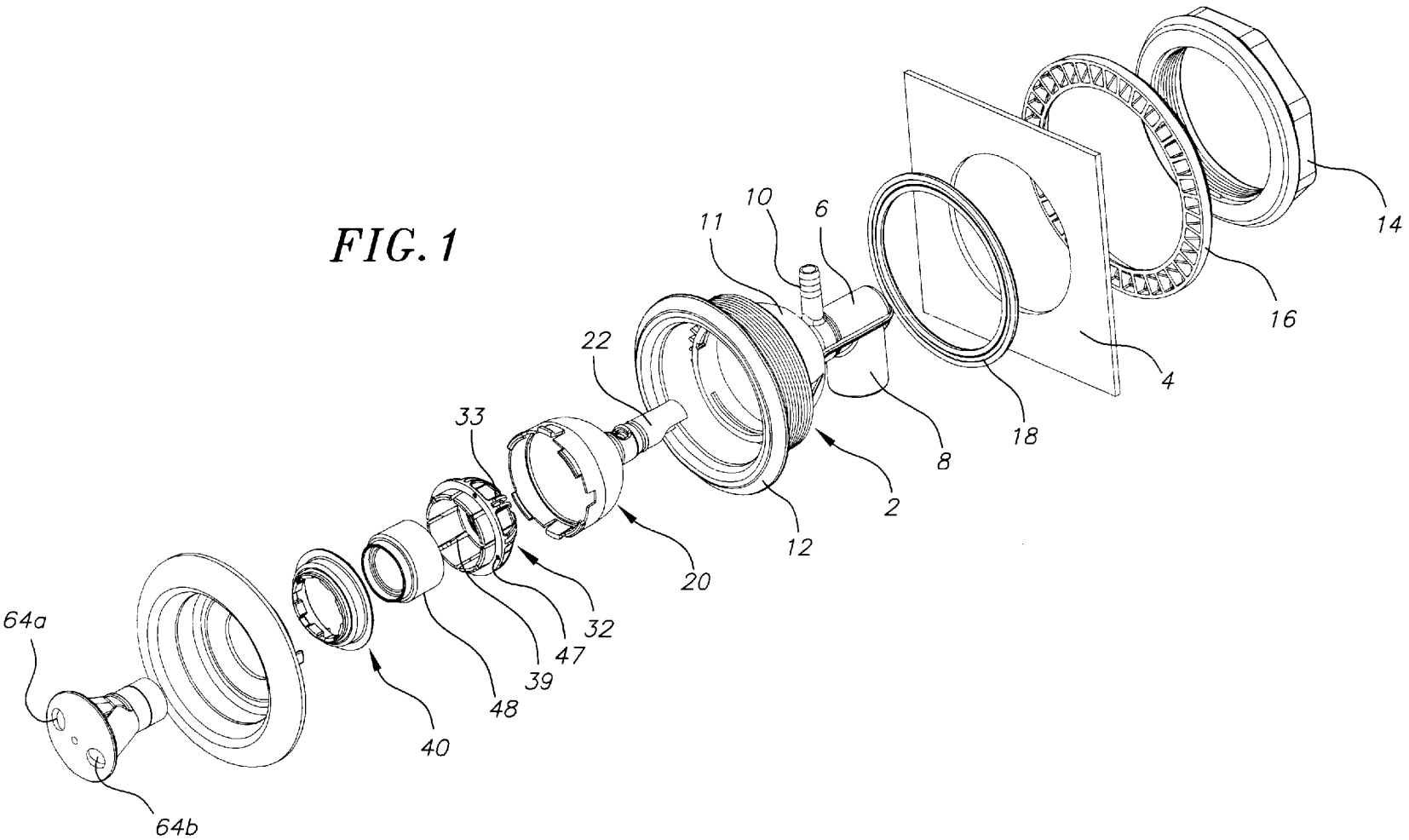
FIG. 1 is an exploded perspective view of a spa jet made in accordance with one preferred embodiment of the present invention.

A spa jet, according to a preferred embodiment of the present invention, is shown in FIG. 1. The spa jet directs a rotating jet of water into the interior of a spa from an outside source of water under pressure. A rotor, having at least one jet nozzle, is supported by a bearing in which the relatively rotating parts are separated by an enveloping layer of water over most of their facing surfaces. The relative dimensioning of the radially extending portion of the bearing surfaces, the water pressure to which they are exposed, and the extent of surface-to-surface contact between radial surfaces coming into contact occur, are designed to reduce surface-to-surface friction that would interfere with the freedom of rotation.

Figure 2:
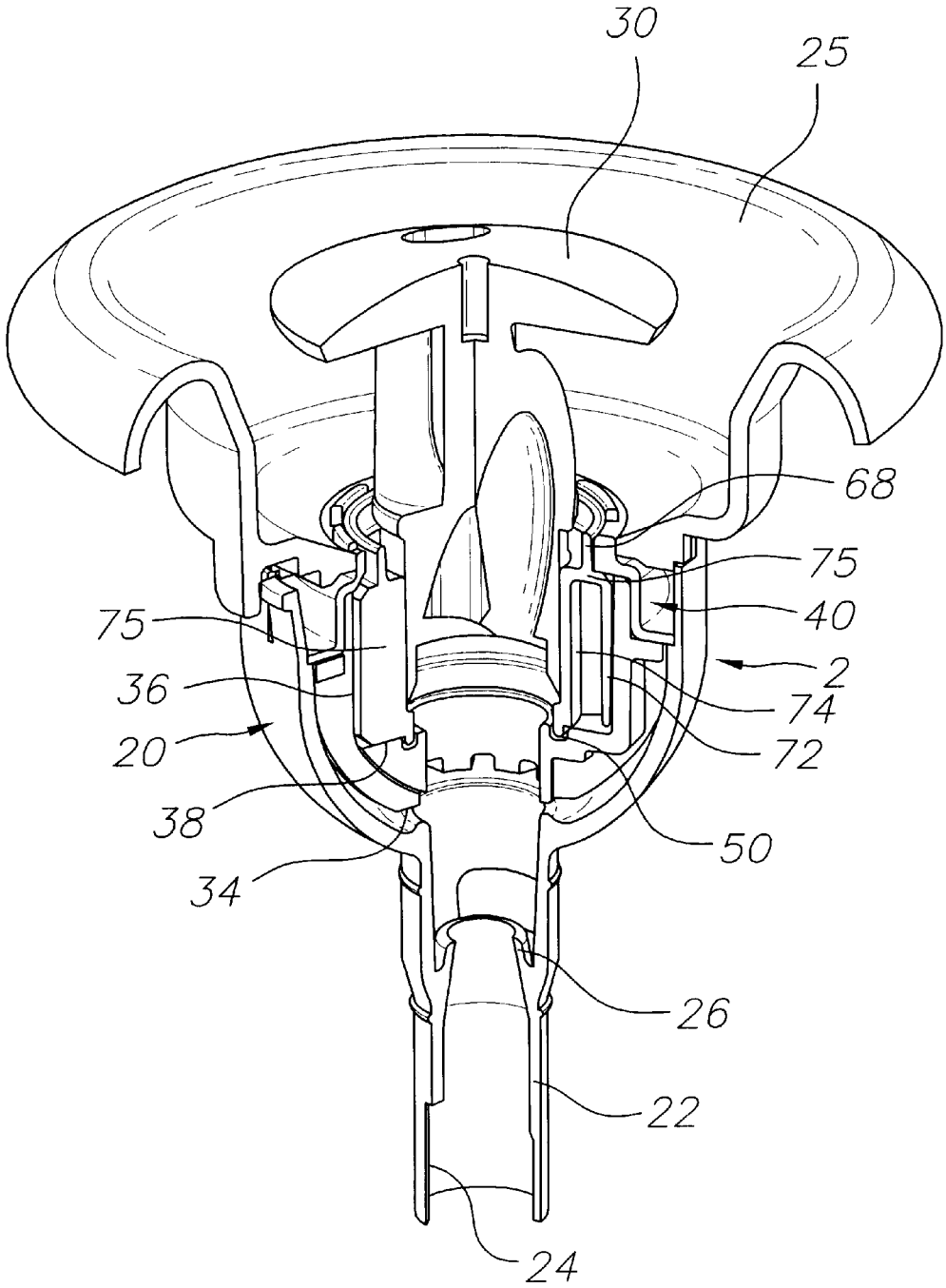
FIG. 2 is a perspective view, partially in cross-section, of the preferred embodiment of the spa jet shown in FIG. 1, with an outer housing, shown in FIG. 1, omitted.
Figure 3:
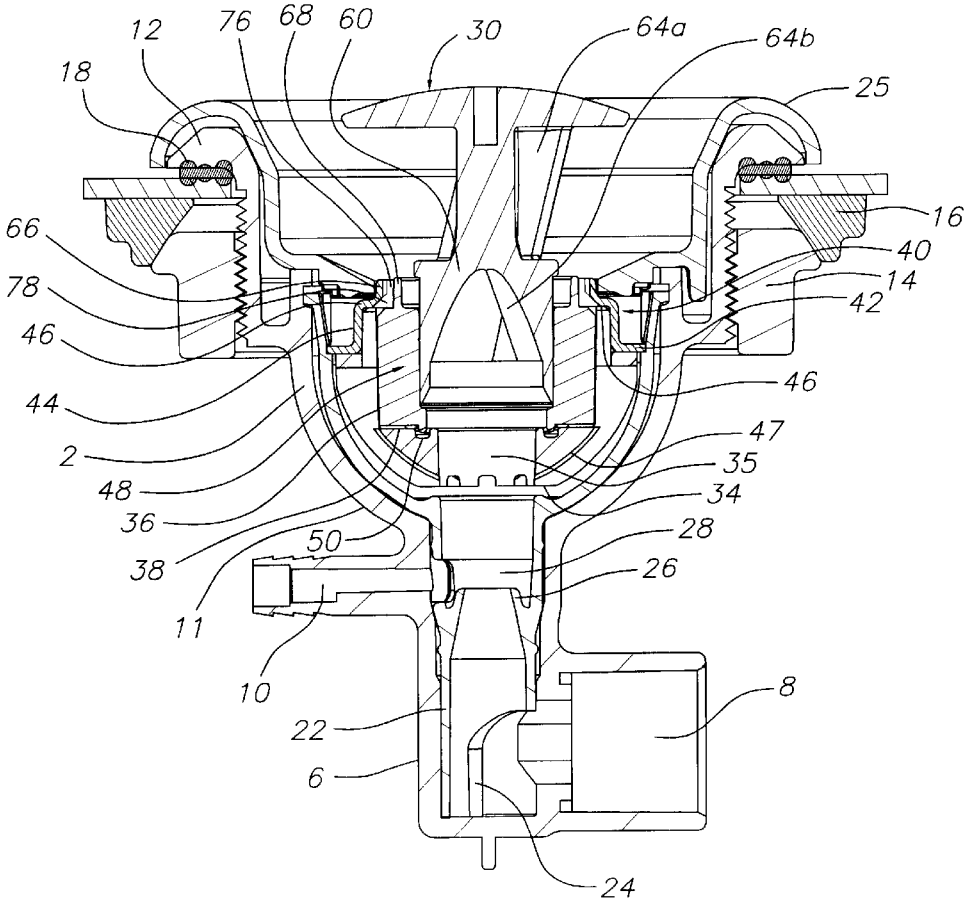
FIG. 3 is a cross-sectional view of the preferred embodiment of the spa jet shown in FIG. 1.

Turning to FIGS. 2 and 3, the preferred embodiment of the spa jet of the present invention includes an outer housing 2 mounted within an opening through the wall 4 of a spa.

The outer housing has an inlet tube 6 connected to the outside source of water under pressure by a right angle, water inlet 8 and to an air source by another right angle, air inlet 10. The inlet tube 6 opens into a chamber wall 11 which is generally cup-shaped and terminates in an enlarged outer flange 12 positioned within the spa. The flange 12 is clamped against the spa wall 4 by an internally threaded clamping ring 14, on the opposite side of the spa wall. The ring 14 bears against a deflector ring 16 that draws the flange 12 against the spa wall as the clamping ring is tightened onto threads on the outer housing. A resiliently deformable sealing ring 18, between the flange and the spa wall, prevents leakage of water out of the spa.

The outer housing includes an inner housing 20 which includes an inlet tube 22 and a chamber wall shaped to fit snugly within the inlet tube and the chamber wall of the outer housing. The inner and outer housings are generally shaped as volumes of rotation, subject to exceptions already discussed, such as the air and water inlet parts, and are concentric about a common axis. The inlet tube 22 has an axially and radially extending slot 24 cut in its upstream end which can be rotated into or out of alignment with the water inlet port 8 to control the flow of water passing through the inlet tube 20 into the spa. An outer adjusting ring 25, which fits over the flange 12, and is mounted for rotation on the outer housing 2, is directly connected to the inner housing. The adjusting ring can be rotated by hand to adjust the water flow through to the spa jet.

The water passing through the inlet tube 22 of the inner housing is accelerated, by passing through a convergent venturi 26, into a mixing chamber region 28 communicating with the air inlet 10. The accelerated water stream entrains air bubbles into the water flow and delivers a mixed flow of water and bubbles.

So far, the parts 2–28 described are the same as, or closely similar to, those described in an earlier U.S. Pat. No. 6,123,274, owned by the assignee of the present invention. The relevant disclosure of that patent, as to common features with the present invention, is incorporated herein by reference.

Of particular interest to the present invention is the provision of a novel bearing assembly which uses a flow of water between its relatively rotating parts to lubricate and separate them thereby reducing friction and promoting freedom of a rotor 30 in which jet nozzles are formed. One part of the bearing assembly is constituted by an outer bearing body generally designated as 32. The outer bearing body is shaped to fit within the chamber wall 24 of the inner housing 20. The body 32 includes a lower, generally hemispherical region with external raised ribs which conform to the inner contour of the chamber wall 24. The body has a lower end face 34 spaced above and facing toward the downstream end of the inlet tube 22. A central passage 35 extends axially through the body 32 to receive the aerated stream of water directed from the venturi 26. The body 32 also has an internal, cylindrical surface 36, concentric with the central axis of the inner and outer housing, and a radially extending upstream end wall 38 at the upstream end of the bearing surface 36. The surface 36 is interrupted by a plurality of peripherally spaced, radially extending channels 39 (FIG. 1).

To hold the outer bearing body 32 in place, a ring 40 is mounted in the open downstream end region of the inner housing 20. The ring 40 has a radially extending outer flange 42, which snap fits into a mating groove extending around the interior of the inner housing, an axially extending central web 44, and an inner flange 46. The inner flange 46 projects inwardly beyond the bearing surface 32 to constitute a downstream end wall. The cylindrical surface 32 and the surfaces of the end walls 38 and 46 collectively define a stationary, outer bearing surface.

The purpose of the outer bearing is to support an inner bearing 48 for rotation. The inner bearing 48 has a ring-shaped body with a cylindrical surface facing the cylindrical surface 36 of the outer bearing. It also has radial end surfaces facing the upstream and downstream end walls 38 and 46. These facing surfaces define a bearing flow passage. In operation, water flow is directed through the bearing flow passage to form an enveloping layer of water which lubricates and supports the inner bearing for friction reduced operation.

Because the surface area of the radial upstream end face of the inner bearing 48 exposed to the flow of water through the bearing flow passage is larger than the corresponding downstream surface, the pressure of water exerts an axial force urging the facing radial surfaces of the inner bearing and the upstream endwall apart. This obviates surface-to-surface friction between them during operation.

This axial force urges the inner bearing into surface-to-surface contact with at least a portion of the downstream end wall 46. Various design features have been incorporated to reduce the frictional effect where the surface contact occurs. First, the axial force urging the inner and outer bearings together has been reduced by lowering the pressure of the water traveling through the bearing flow passage relative to the pressure of the main water stream passing through the spa jet to the spa nozzles. This is achieved by upstream flow inlets 47 to the bearing flow passage from the central passage 35. The flow inlets collect water from a region of the main flow which is at its peripheral edge rather than from the central region of the flow which is traveling more rapidly. The inlet flow passages are narrow, in terms of length to diameter, causing a pressure loss as liquid travels along them to reach the bearing flow passage. Specifically, the inlet passages comprise a plurality of bores, within the hemispherical portion of the bearing body, extending from a point adjacent the upstream end of the central passage 35 to a radially outward region of the bearing flow passage constituting the portion between the end wall 38 and the opposing radial end surface of the inner bearing. Water also enters the annular region of the bearing flow passage from its opposite radially inner end via a peripheral channel 50 between the inner and outer bearings. The pressure losses which occur through the arrangement described lower the pressure in the bearing flow passage.

There are other features which contribute to lower the net axial force urging the inner bearing 48 into contact with the downstream end wall 46. The area of the downstream annular and surface of the inner bearing 48 exposed to fluid pressure is equal to a substantial fraction of the area of the upstream and surface. Because the pressure force of the water passing around the inner bearing acts in opposite axial directions at opposite ends of the inner bearing, the axial forces subtract from each other to reduce the net axial pressure urging the inner bearing 48 against the downstream end wall 46.

These described features complement each other in reducing the magnitude of the rotational friction on the inner bearing 48.

The inner bearing housing 48 supports the rotor 30 for rotation. The rotor 30 has a cylindrical lower body 60 which forms a non-rotating fit within the interior of the inner bearing 48, extending axially into the spa jet in the region surrounded by the adjusting ring 35. The rotor 30 has two slanted axial bores 64*a* and 64*b*, which are symmetrically offset in opposite directions and on opposite sides of the central axis of rotation, at a symmetrical radial offset to the axis of rotation. They produce two complementary, diametrically spaced inclined jets, which have additive turning moments, thereby rotating the rotor in the same direction. Both nozzles, 64*a* and 64*b*, at their upstream end, receive water directly from the central passage 35 through the body 32.

To provide an outlet for the water flowing through the bearing flow passage, the ring 40 and the downstream radial end surface of the inner bearing 48 are provided with concentric axially-extending cylindrical rims 66 and 68, respectively. The rims are spaced apart to define an annular outlet passage between them which communicates with the bearing flow passage and allows water to flow into the interior of the spa. These are a plurality of radially spaced notched openings 78 in the ring 40, at the junction between the web 46 and to the rim 66, to enable flow between the bearing flow passage and interior of the outlet passage 76. The notches and the outlet passage together constitute a flow outlet. The notches also reduce the surface-to-surface frictional contact between the downstream radial end surfaces.

The inner bearing 48 is manufactured as a hollow annular part of U-shaped cross section. Specifically, it has axially extending, cylindrical inner and outer side walls, 72 and 74 joined at the downstream end by a radially extending end wall 76, from which the rim 68 projects (FIG. 2). The inner and outer walls are spaced apart by peripherally spaced solid webs 75 (FIG. 2) to maintain the dimensional shape and sizing of the inner bearing.

Manufacture of the spa jet herein discussed is intended to facilitate high volume, low cost manufacture and to reduce the assembly indicated, in order to reduce the price to the ultimate retail user of a spa jet. Many of the parts described, notably the inner housing 20, the bearing bodies 32 and 36, are volumes of rotation, which may be produced by molding equipment at a lower manufacturing costs than parts made by more expensive techniques, such as machining, casting, or other more complicated procedures. These parts are equipped with a variety of resilient tabs projecting from their peripheral surfaces, which snap into mating slots in the complementary parts into which they fit. The parts described, the outer body, the inner housing, the outer housing, and the rotor are all joined together essentially by relative axial pushing and turning motions. As a result, manufacturing can be a relatively non-complicated procedure, capable of producing the spa jets in volume at significant manufacturing cost savings.

Although references have been made in the foregoing description to a preferred embodiment, persons of ordinary skill in the art of designing spa jets will recognize that insubstantial modifications, alterations, and substitutions can be made to the preferred embodiment described without departing from the invention as claimed in the accompanying claims.

What is claimed is:

1. A spa jet for delivering water from an upstream source of water under pressure to the interior of a spa, the spa jet comprising:

a housing having an inlet tube communicating with the source of water and a chamber wall defining a chamber extending concentrically downstream from said inlet tube and having a relatively enlarged downstream end and defining an axis;

an outer bearing fixedly mounted within said chamber wall adjacent its downstream end, said outer bearing having an internal cylindrical surface concentric with said axis and a central passage through which water from said inlet tube can pass;

annular upstream and downstream end walls positioned at axially opposite ends of said cylindrical surface extending radially inward relative thereto;

an inner bearing mounted for concentric rotation within said outer bearing, said inner bearing having a cylindrical surface facing toward and parallel to the said cylindrical surface and end surfaces facing said end walls of said outer bearing, said facing surfaces having sufficient spacing between them to define an annular bearing flow passage;

inlet and outlet flow passages extending between said bearing flow passage and said central passage and between said bearing flow passage and the interior of the spa, respectively; and a rotor mounted in said inner bearing projecting axially downstream, said rotor having at least one nozzle passage which receives water from said central passage and directs it as a water jet into the spa thereby rotating said inner bearing within said outer bearing, wherein water flow through at least a portion of said bearing flow passage acts on said upstream and downstream end surfaces to urge said end surfaces out of contact at said upstream end and into contact at said downstream end.

2. A spa jet as defined in claim 1 wherein, said inlet flow passage delivers water to said bearing flow passage at a pressure which is lower than the pressure of water passing through said inlet tube to said nozzle passage.

3. A spa jet as defined in claim 1 wherein a portion of said bearing flow passage between said upstream end wall and said inner bearing constitutes an inlet annulus, and wherein there are plural outer inlet passages which extend in spaced relation in and around said inner bearing from said central passage to a radially outer edge of said inlet annulus.

4. A spa jet as defined in claim 3 which further includes at least one inner inlet which extends between said central passage and a radially inner edge of said inlet annulus.

5. A spa jet as defined in claim 1 wherein, said outer bearing includes a body shaped to fit within said chamber wall, said central passage, said internal cylindrical surface and said upstream end wall being formed in said body, said inlet flow passage extending within said body from said central passage to said bearing flow passage.

6. A spa jet as defined in claim 1 further including, a ring mounted within the downstream end of said chamber wall extending axially into contact with said outer bearing, said ring having a radially inward region which constitutes said downstream end wall;

said ring and said inner bearing having axially projecting, concentric, cylindrical rims which are spaced apart to define said outlet flow passage and which communicate with said bearing flow passage.

7. A spa jet as defined in claim 1 wherein, said inlet tube, at a point therein upstream of said outer bearing, has a venturi positioned to direct a stream of water passing through the inlet tube to said nozzle passage in said rotor, said inlet flow passage being positioned outside the stream directed by said venturi thereby collecting water at a relatively lower pressure and directing it to said bearing flow passage.

8. A spa jet as defined in claim 1 wherein, said inner bearing is formed as a molded part of generally U-shaped cross-section having radially spaced, axially extending cylindrical side walls joined at their top by a radial wall and also by axially extending, radially spaced internal webs to maintain the shape and dimensions of said bearing.

* * * * *